US010307684B2

(12) United States Patent
Choi

(10) Patent No.: US 10,307,684 B2
(45) Date of Patent: Jun. 4, 2019

(54) TRANSFORMABLE TOY CAR

(71) Applicant: Shin-Kyu Choi, Seoul (KR)

(72) Inventor: Shin-Kyu Choi, Seoul (KR)

( * ) Notice: Subject to any disclaimer, the term of this patent is extended or adjusted under 35 U.S.C. 154(b) by 166 days.

(21) Appl. No.: 14/782,154

(22) PCT Filed: Apr. 2, 2014

(86) PCT No.: PCT/KR2014/002810
§ 371 (c)(1),
(2) Date: Oct. 2, 2015

(87) PCT Pub. No.: WO2014/163387
PCT Pub. Date: Oct. 9, 2014

(65) Prior Publication Data

US 2016/0045835 A1 Feb. 18, 2016

(30) Foreign Application Priority Data

Apr. 3, 2013 (KR) ..... 10-2013-0036555

(51) Int. Cl.

| | |
|---|---|
| ***A63H 30/04*** | (2006.01) |
| ***A63H 17/26*** | (2006.01) |
| ***A63H 33/00*** | (2006.01) |
| ***A63H 17/02*** | (2006.01) |
| ***A63F 1/00*** | (2006.01) |
| ***A63F 1/06*** | (2006.01) |

(52) U.S. Cl.
CPC ..... *A63H 17/26* (2013.01); *A63F 1/00* (2013.01); *A63F 1/06* (2013.01); *A63H 17/02* (2013.01); *A63H 17/266* (2013.01); *A63H 33/003* (2013.01)

(58) Field of Classification Search
CPC ..... A63H 3/28; A63H 17/26; A63H 17/262; A63H 30/04
See application file for complete search history.

(56) References Cited

U.S. PATENT DOCUMENTS 4,413,443 A * 11/1983 Kulesza ..... A44C 9/0061 446/26
4,678,451 A * 7/1987 Ventura ..... A63H 17/262 446/471
4,693,693 A * 9/1987 Kennedy ..... A63H 17/02 446/470

(Continued)

FOREIGN PATENT DOCUMENTS

JP 2000-210476 A 8/2000
JP 2011-120756 A 6/2011

(Continued)

OTHER PUBLICATIONS

Machine translation of KR99065295A from Korean to English.*
International Search Report dated Jul. 31, 2014, in counterpart International Application No. PCT/KR2014/002810, 53 Pages

*Primary Examiner* — John E Simms, Jr.
*Assistant Examiner* — Urszula M Cegielnik
(74) *Attorney, Agent, or Firm* — NSIP Law

(57) ABSTRACT

The purpose of the present invention is to provide a transformable toy car, the driving of which can be controlled from a remote location and which transforms from a car shape into an arbitrary second shape, thereby exposing the lower surface of an attached card when an arbitrary card is attached to the car while the car is traveling.

9 Claims, 7 Drawing Sheets

(56) References Cited

U.S. PATENT DOCUMENTS 4,762,511 A * 8/1988 Lee ..... A63H 17/02 446/469
4,936,809 A * 6/1990 Auer ..... A63H 5/00 446/183
5,129,851 A * 7/1992 Villanueva ..... A63H 33/003 446/26
5,131,880 A * 7/1992 Nesbit ..... A63H 17/44 273/458
5,366,227 A * 11/1994 Duffy ..... A63F 11/0002 273/148 A
5,389,031 A * 2/1995 Sharpe, III ..... A63H 5/00 446/397
5,713,783 A * 2/1998 Szoke ..... A63H 17/02 446/219
5,759,083 A * 6/1998 Polumbaum ..... A63H 17/006 273/129 V
5,906,528 A * 5/1999 Ostendorff ..... A63H 17/02 446/176
6,390,878 B1 * 5/2002 Zhou ..... A63H 17/26 446/14
D508,532 S * 8/2005 Hert ..... D19/82
D522,239 S * 6/2006 Herring ..... D3/248
8,066,542 B2 * 11/2011 Ejima ..... A63H 17/02 446/376
2002/0063008 A1 * 5/2002 Spies ..... B60R 13/04 180/274
2002/0177383 A1 * 11/2002 Hornsby ..... A63H 3/48 446/175
2003/0020239 A1 * 1/2003 Hagen ..... A63F 1/02 273/296
2008/0015037 A1 * 1/2008 Blum ..... A63J 1/02 472/43
2008/0166946 A1 * 7/2008 Gallagher ..... A63H 17/395 446/428
2011/0111672 A1 * 5/2011 Miyake ..... A63H 17/02 446/378
2011/0269366 A1 * 11/2011 Sugimoto ..... A63H 33/003 446/72
2013/0109273 A1 * 5/2013 Koshida ..... A63H 17/004 446/465
2013/0122779 A1 * 5/2013 Doherty ..... A63H 29/24 446/460
2015/0050859 A1 * 2/2015 Choi ..... A63H 17/02 446/72

FOREIGN PATENT DOCUMENTS

KR 10-1999-0065295 A 8/1999
KR 10-2009-0057895 A 6/2009
WO WO 2013/125836 A2 * 8/2013 ..... A63H 17/26

* cited by examiner

TRANSFORMABLE TOY CAR

CROSS-REFERENCE TO RELATED APPLICATIONS

This application is a U.S. National Stage Application of International Application No. PCT/KR2014/002810, filed on Apr. 2, 2014, which claims the benefit under 35 USC 119(a) and 365(b) of Korean Patent Application No. 10-2013-0036555, filed on Apr. 3, 2013, in the Korean Intellectual Property Office.

TECHNICAL FIELD

The present invention relates to a toy car and, more specifically, to a transformable toy car, wherein the traveling of a car can be controlled at a remote place, and the car can be deformed from a car shape into an arbitrary second shape so as to expose the bottom surface of an arbitrary card if the card is attached thereto in the process of traveling of the car.

BACKGROUND ART

A deformable toy includes various body parts formed in the shape of a robot or a car such that the body parts can be deformed into a robot or a car through the assembling thereof. Such a deformable toy has advantages that the deformable toy can be expressed in various shapes out of a single toy such that children can directly assemble the same into various shapes and enjoy various play through the deformation thereof.

Meanwhile, one of the most popular children card games uses a pack of cards, each formed in the shape of a rectangle and having markings such as pictures, characters and the like for playing printed on the front or rear surface thereof, and is played by turning over such a card having the markings such as pictures, characters and the like according to predetermined game rules.

Such a card game for children is played by spreading the cards on a table and turning over the cards by hand to check the markings. Therefore, the game is so simple that children are apt to lose interest and has no particular functions except that the children collect the cards having the same markings on the surface of the cards.

Meanwhile, a wirelessly controlled car well-known from the prior art or disclosed in Korea Patent Registration No. 10-0362592 typically includes a model toy car provided with a driving device such as a driving motor, a steering device, a battery, driving wheels and the like therein, and a remote control device for remotely controlling the car in the back-and-forth and right-and-left directions.

However, the conventional wirelessly controlled car is just provided with functions relating to the traveling of the car and thus children are also apt to lose interest in the remote control thereof.

DISCLOSURE

Technical Problem

Accordingly, the present invention has been made in an effort to solve the above-mentioned problems occurring in the prior arts, and it is an objective of the present invention to provide a transformable toy car, the driving of which can be controlled at a remote place and which can be transformed from a car shape into an arbitrary second shape, thereby exposing the lower surface of an arbitrary card when the arbitrary card is attached to the car while the car is traveling.

Technical Solution

In order to achieve the above objective, the present invention provides a transformable toy car, comprising: a car for carrying out travelling operation in an arbitrary direction according to an operation control signal of a remote control unit, being transformed from a first shape into a second shape at parts of a body, which are rotationally coupled so as to expose the bottom surface of an arbitrary card attached thereto, if the card is attached, and restored to the first shape from the transformed second shape if the attached card is removed; and the remote control unit for outputting a direction control signal such that the car travels in an arbitrary direction.

Further, the present invention provides a transformable toy car, comprising: a car for receiving an operation control signal and attachment target card information transmitted from a remote control unit so as to carry out travelling operation in an arbitrary direction, scanning an arbitrary card so as to compare the scanned card information with the attachment target card information, being transformed from a first shape into a second shape at parts of a body, which are rotationally coupled, so as to attach an attachment target card and expose the bottom surface of the attachment target card, if the scanned card is the attachment target card as a result of the comparison, and being restored from the transformed second shape to the first shape if the attached card is removed in the transformed second shape; and the remote control unit for outputting a direction control signal such that the car travels in an arbitrary direction and receiving the input information on the attachment target card so as to transmit the input information on the attachment target card to the car.

Further, as for the transformable toy car according to the present invention, the car includes: a deformation support fixed on a lower frame; a bonnet support rotationally coupled to one side of the deformation support such that a bonnet frame is deformed from a first shape into a second shape; a roof support rotationally coupled to the other side of the deformation support such that a roof frame is deformed from a first shape into a second shape; a link part for connecting the bonnet support and the roof support such that the roof support operates together with the bonnet support when the bonnet support rotates; a fender support, of which one side is connected to the link part and the other side is connected to fender frames such that the fender frames are deformed from a first shape into a second shape; a first driving unit provided to the deformation support such that the bonnet support rotates forwards or backwards in a predetermined direction so as to supply driving force; a second driving unit provided to the lower frame and rotating forwards or backwards so as to supply driving force such that the car travels in a predetermined direction; a third driving unit provided to the lower frame and rotating forwards or backwards so as to supply driving force such that the car travels in a predetermined direction; auxiliary wheels provided at the lower portion of the lower frame; and a control circuit part for outputting a traveling control signal to the second and third driving units for traveling in an arbitrary direction if an operation control signal is received from the remote control unit, and outputting a deformation control signal according to whether a card is attached or not such that the first driving unit rotates forwards or backwards.

Further, according to the present invention, the car further includes door link parts, and each of the link part includes a door coupling hole coupled to a door frame such that the door frame is deformed from a first shape into a second shape, and a link guide coupling part and a roof support coupling hole respectively provided at one side and the other side of the door link part with respect to the door coupling hole, the link guide coupling part being rotationally coupled to the link part, and the roof support coupling hole being coupled to the roof support.

Further, according to the present invention, the control circuit part includes: an RF transceiver for transmitting and receiving data signals with respect to the remote control unit; a sensor unit for outputting an on/off-signal according to whether a card is attached to a magnet; a first switch provided to the deformation support so as to output an on/off-signal according to the position of the bonnet support; a second switch provided to the deformation support so as to output an on/off-signal according to the position of the roof support; and a control unit for outputting a traveling control signal to the second and third driving units so as to carry out traveling in an arbitrary direction if the RF transceiver receives an operation control signal, outputting a deformation control signal according to the on/off-signal outputted from the sensor unit such that the first driving unit rotates forwards or backwards, and outputting the deformation control signal to the first driving unit until any one of the first or second switch outputs an on-signal.

Further, according to the present invention, the control circuit part includes: a first switch provided to the deformation support and outputting an on/off-signal according to the position of the bonnet support; a second switch provided to the deformation support and outputting an on/off-signal according to the position of the roof support; a control unit for outputting a traveling control signal to the second and third driving units so as to carry out traveling in an arbitrary direction if an operation control signal and attachment target card information are received from the remote control unit, comparing the card information scanned by the RF reader unit with the received attachment target card information, outputting an on/off-control signal for an electromagnet part and a deformation control signal for rotating the first driving unit forwards or backwards according to the comparison result, and outputting the deformation control signal to the first driving unit until any one of the first or second switch outputs an on-signal; a local communications unit for transmitting or receiving data signals between the control unit and the remote control unit; the RF reader unit for scanning information on an arbitrary card so as to transmit the scanned information to the control unit; and the electromagnet part for generating magnetic force according to the on/off-control signal of the control unit and outputting an on/off-signal according to whether the card is attached or not.

Further, according to the present invention, the remote control unit is any one of a mobile terminal and a tablet PC.

Further, according to the present invention, the communications between the car and the remote control unit are carried out using at least one of RF communications, bluetooth communications, Zigbee communications or infrared-ray communications.

Further, according to the present invention, the card includes at least one of a magnetic substance or unique ID information.

Advantageous Effects

The present invention has advantages that the driving of a toy car can be controlled from a remote location and the toy car can be transformed from a car shape into an arbitrary second shape, thereby exposing the lower surface of an attached arbitrary card when the arbitrary card is attached to the car while the car is traveling.

Further, the present invention has advantages that card games and toy car play using remote controlling are combined such that children themselves can suggest various playing methods, thereby improving the interest in play.

EXPLANATION OF ESSENTIAL REFERENCE NUMERALS IN DRAWINGS

| | |
|---|---|
| 100, 100': car | 101: lower frame |
| 102: battery housing | 103: fender frames |
| 104: bonnet frame | 105: roof frame |
| 106: door frames | 107: rear frame |
| 110: deformation support | 120: bonnet support |
| 130: roof support | 140: link part |
| 141: first link rotary shafts | |
| 142: second link rotary shafts | |
| 143: link insertion part | 144: link guide parts |
| 150: fender support | 151: fender fixing frame |
| 152: link part coupling groove | |
| 160: door link parts | 161: door coupling hole |
| 162: link guide coupling part | |
| 163: roof support coupling hole | |
| 170: first driving unit | 171: second driving unit |
| 172: third driving unit | 173: driving wheel |
| 180: auxiliary wheels | |
| 190, 190': control circuit part | |
| 191: RF transceiver | 192: sensor unit |
| 192': magnet | 192a: first switch |
| 192b: second switch | 193, 193': control unit |
| 194: power supply | |
| 195: local communications unit | |
| 196: RF reader unit | 197: electromagnet part |
| 200, 200': remote control unit | |
| 300: card | 300a: first card |
| 300b: second card | 300c: third card |

[Mode for Invention]

Hereinafter, with reference to the attached drawings, a transformable toy car according to embodiments of the present invention will be described in detail.

(Embodiment 1)

Figure 1:
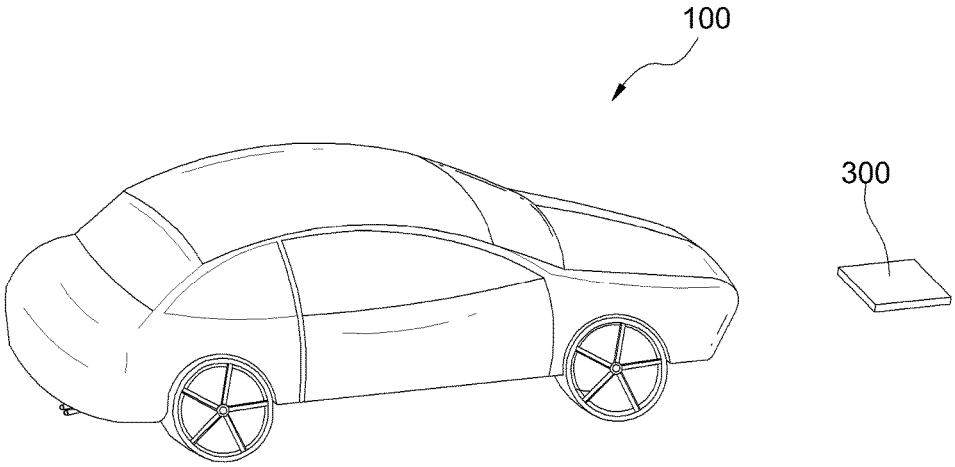
FIG. 1 is a perspective view showing a transformable toy car according to a first embodiment of the present invention.
Figure 2:
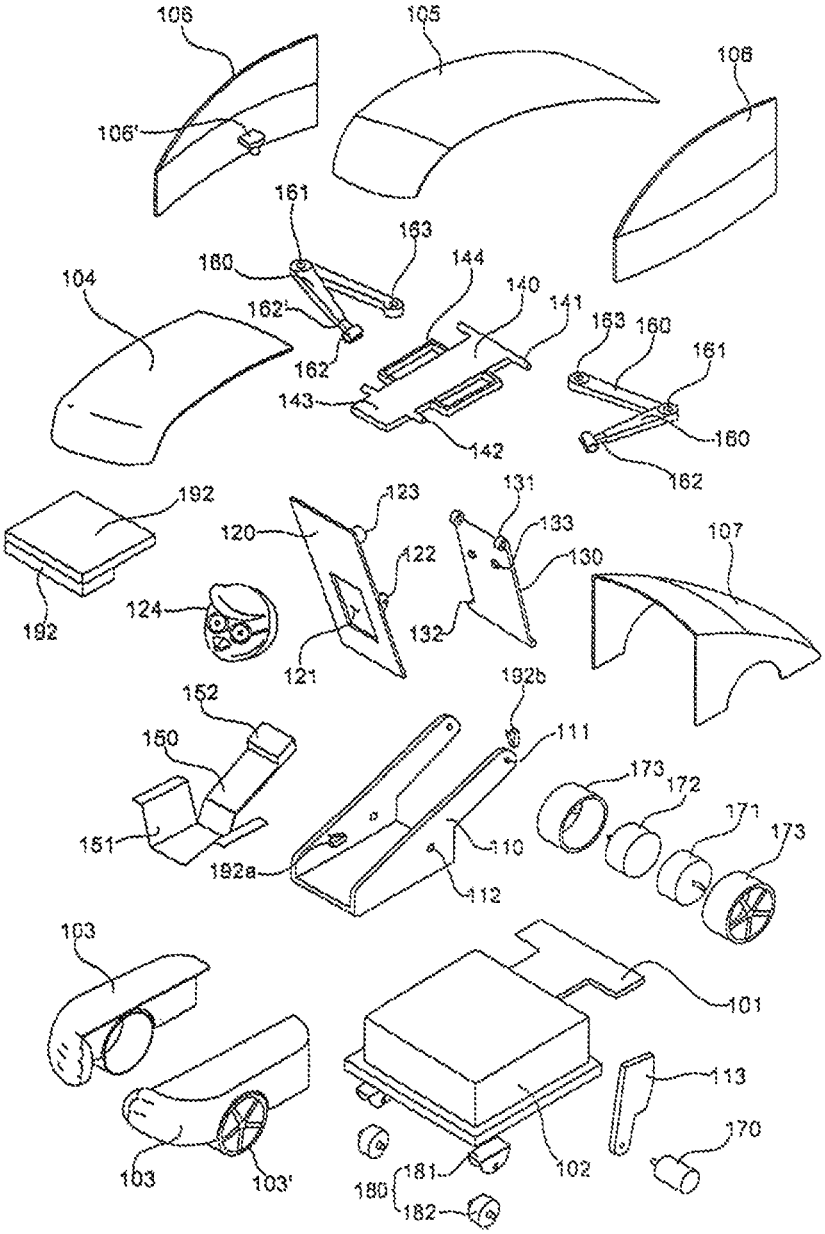
FIG. 2 is an exploded perspective view for showing the structure of the transformable toy car according to the first embodiment of the present invention.
Figure 3:
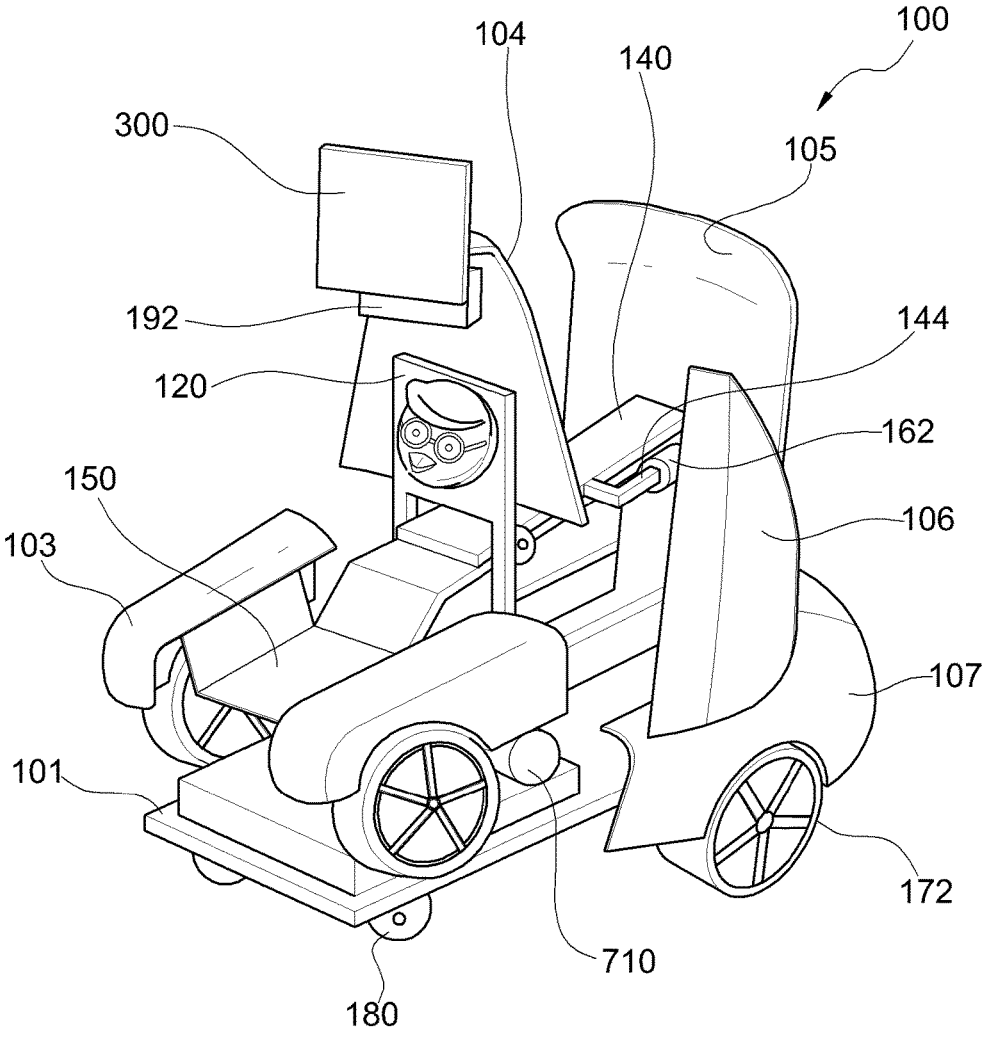
FIG. 3 is a perspective view for showing an after-deformation state of the transformable toy car according to the first embodiment of the present invention.
Figure 4:
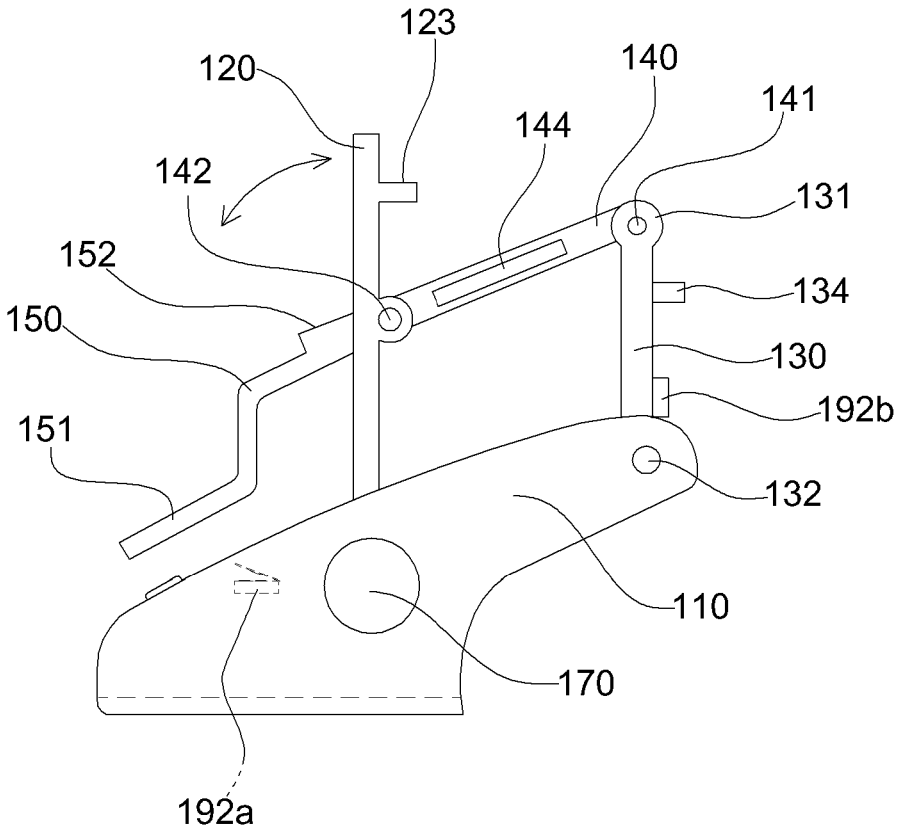
FIG. 4 is a side view for showing parts of deformation means of the transformable toy car according to the first embodiment of the present invention.
Figure 5:
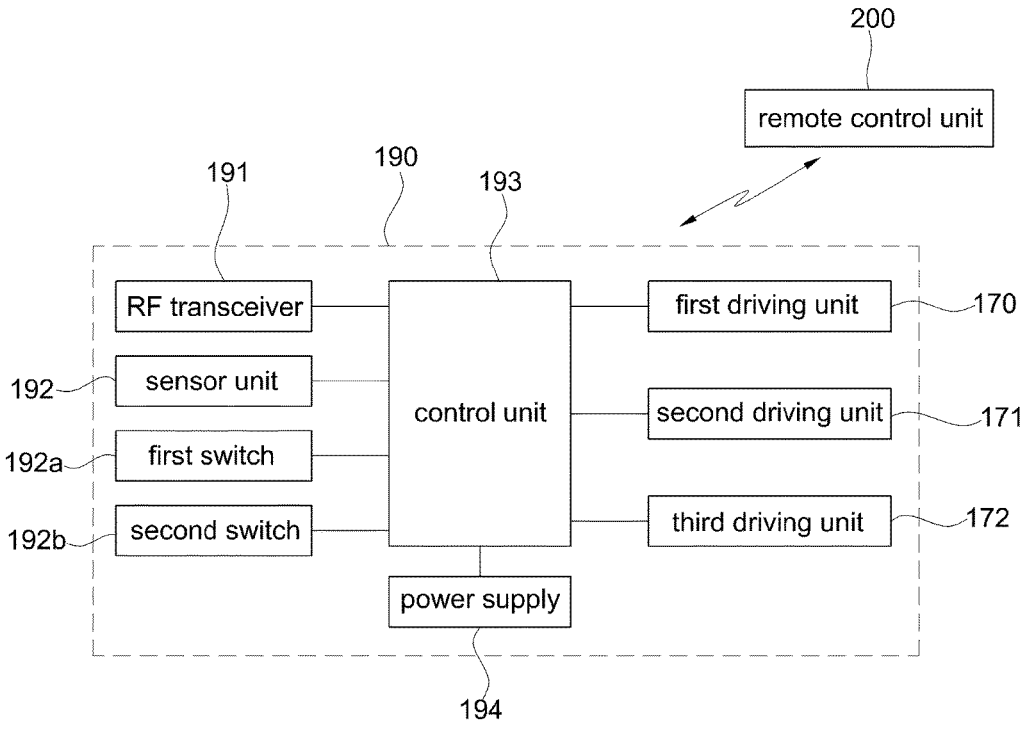
FIG. 5 is a block diagram for showing the electric configuration of the transformable toy car according to the first embodiment of the present invention.

FIG. 1 is a perspective view showing a transformable toy car according to a first embodiment of the present invention, FIG. 2 is an exploded perspective view for showing the structure of the transformable toy car according to the first embodiment of the present invention, FIG. 3 is a perspective view for showing an after-deformation state of the transformable toy car according to the first embodiment of the present invention, FIG. 4 is a side view for showing parts of deformation means of the transformable toy car according to the first embodiment of the present invention, and FIG. 5 is a block diagram for showing the electric configuration of the transformable toy car according to the first embodiment of the present invention.

As shown in FIG. 1 to FIG. 5, in order to control the driving of a toy car at a remote place and transform the toy car from a car shape into an arbitrary second shape so as to expose the lower surface of an attached arbitrary card when the arbitrary card is attached to the car while the car is traveling, a deformable toy car, according to a first embodiment of the present invention, includes a car 100, a remote control unit 200 and a card 300. The car 100 carries out traveling operation in an arbitrary direction according to an operation control signal of a remote control unit 200, and is transformed at rotationally coupled body parts of the car from a first shape into a second shape so as to expose the bottom surface of an attached arbitrary card 300, if the arbitrary card 300 is attached, and then restored from the deformed second shape to the first shape of original positions if the attached card 300 is removed. As for the above configuration, the car 100 includes a car body frame part for forming the car shape as the first shape, a deformation part of which position is variable for the deformation from the first shape into the second shape, and a driving unit for controlling the traveling and the deformation of the car 100.

The car body frame part includes a lower frame 101, fender frames 103, a bonnet frame 104, a roof frame 105, door frames 106 and a rear frame 107, thereby forming a car shape on the whole as a first shape.

The lower frame 101 is a plate member formed in the shape of a rectangle, of which upper portion is provided with a battery housing 102, which is provided with a battery (not shown) and a control circuit part 190, a deformation support 110, a first driving unit 170, a second driving unit 171 and a third driving unit 172, and a lower portion is provided with auxiliary wheels 180.

The fender frames 103 are members formed as fenders at both sides of the front part of the car 100 in the first shape and as both arms of a robot in a second shape at the time of deformation, and include wheels 103'.

The bonnet frame 104 is a member formed as the bonnet of the car 100 at the front part of the car 100 in the first shape and making the bottom surface of the card 300 attached to the sensor unit 192 and the inbuilt face of the robot in the second shape appear at the time of deformation.

The roof frame 105 is a member formed as the roof of the car 100 at the upper portion of the car 100 in the first shape and forming the body of the robot in the second shape at the time of deformation.

The door frames 106 are members formed as the doors of the car 100 at both side surfaces of the car 100 in the first shape and forming the body of the robot in the second shape at the time of deformation.

The rear frame 107 is formed as the rear part of the car 100 at the rear side of the car in the first shape.

The deformation part is a constituent element for changing the positions of the fender frames 103, the bonnet frame 104, the roof frame 105 and the door frames 106 for the deformation from the car shape as the first shape into, for example, the robot shape as the second shape, and includes the deformation support 110, the bonnet support 120 and the roof support 130, the link part 140, the fender support 150, the door link parts 160 and the auxiliary wheels 180.

The deformation support 110 is a constitutional element fixed on the upper portion of the battery housing 102 provided to the lower frame 101 so as to support the bonnet support 120, the roof support 130 and the first driving unit 170 to be mounted, wherein a roof support mounting hole 111 provided at one side is coupled to the roof support 130, allowing the rotation of the roof support 130, and first driving unit mounting holes 112 are penetrated forming a stepped portion at a position spaced from the roof support mounting hole 111 at a predetermined distance and are provided with the first driving unit 170 such that the bonnet support 120 rotates by the forward or backward rotation operation of the first driving unit 170.

Further, the bonnet support 120 is a plate member formed in the shape of a rectangle and coupled to the bonnet frame 104, wherein the bonnet support 120 is rotationally coupled to one side of the deformation support 110 through the first driving unit 170 such that the bonnet frame 104 can be deformed from the first shape into the second shape.

Further, the bonnet support 120 has a through hole 121 formed in the center in the longitudinal direction so as to be penetrated by the link part 140 and the fender support 150, a link part mounting hole 122 formed in the center of one side surface such that the link part 140 is rotationally coupled to the bonnet support 120, and a bonnet frame coupling part 123 for fixing the bonnet frame 104.

In addition, a face part 124 is provided on the bottom surface of the bonnet support 120 and has a shape of an arbitrary character face and the like.

The roof support 130 is a plate member formed in the shape of a rectangle and coupled to the roof frame 105, wherein the roof support 130 is rotationally coupled to the other side of the deformation support 110 through the roof support mounting hole 111 such that the roof frame 105 can be deformed from the first shape into the second shape. The roof support 130 has link part mounting holes 131 formed at one side, a roof support rotary shaft 132 formed at the other side so as to be rotationally coupled in the roof support mounting hole 111 of the deformation support 110, and door link part coupling holes 133 penetrated to be coupled to the door link parts 160.

The link part 140 is a constitutional element for connecting the bonnet support 120 and the roof support 130 such that the roof support 130 carries out rotation operation together with the bonnet support 120 when the bonnet support 120 rotates. The link part 140 has first link rotary shafts 141 formed at one side such that the link part 140 is rotationally coupled in the link part mounting holes 131 of the roof support 130, second link rotary shafts 142 formed at the other side such that the link part 140 is rotationally coupled in the link part mounting hole 122 of the bonnet support 120, and a link insertion part 143 extending a predetermined length from the end portion, on which the second rotary shaft 142 is formed.

Further, the link part 140 has link guide parts 144 formed at both sides of the link part 140 in the longitudinal direction such that parts of the door link parts 160 are rotationally coupled to the link guide parts 144.

The fender support 150 is a constitutional element connected to the link part 140 at one side and the fender frames 103 at the other side and allows the fender frames 103 to be deformed from the first shape into the second shape as the bonnet support 120 rotates. The fender support 150 has a fender fixing frame 151 having a cross-section in the shape of an approximate "U" at one side so as to fix the fender frames 103, and a link part coupling groove 152 formed on the other side so as to be coupled to the link insertion part 143 of the link part 140.

Each of the door link parts 160 has a door coupling hole 161 coupled to the door frames coupling part 106' of the door frame 106 such that the door frame 106 can be deformed from the first shape into the second shape, a link guide coupling part 162 formed at one side of the door coupling hole 161 and coupled to the link part 140 so as to freely rotate a full 360 degrees with respect to the rotary shaft 162', and a roof support coupling hole 163 provided to the other side so as to be coupled to the roof support 130.

That is, if one side of the door link part 160 is coupled to the link guide part 144 through the link guide coupling part 162 and thus an interval between the roof support 130 and the link part 140 is increased or decreased, the link guide coupling part 162 and the roof support coupling hole 163 move closer to or farther from each other. At this time, the door coupling hole 161 moves to a position closer to or farther from the body of the car 100.

This movement makes the motion of the door frame 160 looks larger, raising vividness, when the car 100 is deformed from the first shape into the second shape and vice versa.

The auxiliary wheels 180 are provided at the lower portion of the lower frame 101 and come into contact with the floor surface such that the car 100 can travel even without the wheels 103', which are provided to the fender frames 103, after the deformation of the car 100 into the second shape. The auxiliary wheels 180 includes auxiliary wheel members 182 and auxiliary wheel supports 181.

The driving unit includes the first driving unit 170, the second driving unit 171, the third driving unit 172 and the control circuit part 190.

The first driving unit 170 is a constituent element formed as a motor member by using a DC motor, a servo motor, a stepping motor, various reduction gears and the like and provided to the deformation support 110 so as to supply driving force to the bonnet support 120 by the forward or backward rotation operation of the first driving unit 170, wherein the first driving unit 170 is stably fixed to the bonnet support 120 through a rotary shaft support 113.

In addition, if the first driving unit 170 is formed using a DC motor, the first driving unit 170 can include a gear means (not shown) such as a reducer and the like.

The second driving unit 171 is a constituent element provided to the lower frame 101 and rotates forwards or backwards so as to supply driving force such that the car 100 can travel in a predetermined direction and formed using a DC motor, a servo motor, a stepping motor and the like, wherein the second driving unit 171 is provided with a driving wheel 173.

The third driving unit 172 is a constituent element provided to the lower frame 101 and rotating forwards or backwards so as to supply driving force such that the car 100 can travel in a predetermined direction. The third driving unit 172 may be formed using a DC motor, a servo motor, a stepping motor and the like and is provided with another driving wheel 173.

The control circuit part 190 is a constituent element for outputting a traveling control signal to the second and third driving units 171, 172 so as to carry out traveling in an arbitrary direction if an operation control signal is received from the remote control unit 200, 200', and outputting a deformation control signal such that the first driving unit 170 rotates forwards or backwards according to whether a card 300 is attached. The control circuit part 190 includes an RF transceiver 191 and a sensor unit 192, a first switch 192*a*, a second switch 192*b*, a control unit 193 and a power supply 194.

The RF transceiver 191 is a constituent element for transmitting and receiving data signals with respect to the remote control unit 200. The RF transceiver 191 carries out wireless data communications so as to receive a direction-signal provided by the remote control unit 200 and output the same to the control unit 193.

The sensor unit 192 is a constituent element provided at the front lower part of the bonnet frame 104 and outputting an on/off-signal according to whether a card 300 is attached. The sensor unit 192 includes a magnet 192' such that the card 300 can be attached and outputs the on/off-signal according to the position of the magnet 192'.

That is, the sensor unit 192 can detect an off-state if the magnet 192' maintains an arbitrary position by the elasticity of a spring (not shown) when a card 300 is not attached, while the position of the magnet 192' is changed and the sensor unit 192 can detect an on-state if the magnetic substance included in the card 300 is magnetized by the magnetic force of the magnet 192' such that the card 300 is attached to the magnet 192'. At this time, if the attached card 300 is removed from the magnet 192', the magnet 192' is restored to the original position thereof, that is, to the off-state by the elasticity of the spring.

The first switch 192*a* is a limit switch provided at one side of the deformation support 110 in the horizontal direction, and outputs an on-signal to the control unit 193 so as to finish the operation of the first driving unit 170, when the bonnet support 120 comes to a horizontal state so as to maintain the first shape.

That is, the first switch 192*a* outputs an on-signal if the car has the first shape.

The second switch 192*b* is a limit switch provided at the other side of the deformation support 110 in the vertical direction, and outputs an on-signal to the control unit 193 so as to finish the operation of the first driving unit 170, when the roof support 130 stands in the vertical direction for the deformation into the second shape.

That is, the second switch 192*b* outputs an on-signal if the car comes to the second shape.

If the RF transceiver 191 receives an operation control signal from the remote control unit 200, the control unit 193 analyzes the received operation control signal and outputs a traveling control signal to the second and third driving units 171, 172 such that the car 100 travels in an arbitrary direction.

In addition, the control unit 193 detects an on/off-signal outputted from the second sensor unit 192 so as to analyze the same. As a result of the analysis, the control unit 193 allows the first driving unit 170 to rotate forwards at a predetermined angle from an arbitrary reference position in the case of an on-signal indicating that a card 300 is attached, while outputs a deformation control signal and allows the first driving unit 170 to rotate backwards at a predetermined angle so as to be restored to the reference position in the case of an off-signal indicating that a card 300 is not attached.

Further, if the control unit 193 detects an on-signal from the sensor unit 192 and outputs an operation control signal to the first driving unit 170 so as to carry out deformation from the first shape into the second shape, the control unit 193 outputs the operation control signal to the first driving unit 170 until the first switch 192*a* outputs an off-signal and the second switch 192*b* outputs an on-signal, thereby enabling accurate deformation from the first shape into the second shape.

Further, if the control unit 193 detects an off-signal from the sensor unit 192 and outputs an operation control signal to the first driving unit 170 so as to carry out deformation from the second shape to the first shape, the control unit 193 outputs the operation control signal to the first driving unit 170 until the second switch 192*b* outputs an off-signal and the first switch 192*a* outputs an on-signal, thereby enabling accurate deformation from the second shape to the first shape.

The power supply 194 is a constituent element for supplying power for the operation of the car (100) and includes at least one of a primary cell or a secondary cell.

The remote control unit 200 is a constituent element for receiving back-and-forth and right-and-left direction control signals inputted by a user such that the car 100 travels in an arbitrary direction, and can be formed using a well-known remote controller.

Further, the remote control unit 200 is a communications means between the car 100 and the remote control unit 200 and uses at least one of RF communications, bluetooth communications, Zigbee communications or infrared-ray communications, preferably RF communications using an arbitrary frequency.

The card 300 is a rectangular member and has at least one of letters, numbers, figures, pictures, characters and photographs, printed on the outside and an inside part, and a magnetic substance, a core and the like incorporated therein so as to be magnetized as magnetic force is applied thereto.

Next, the operation procedure of a transformable toy car according to a first embodiment of the present invention will be described in more detail.

A user operates the remote control unit 200 such that the car 100 in the first shape as a car towards a card 300 which is spaced from the car 100 at a predetermined distance.

The control unit 193 of the car 100 receives the operation control signal from the remote control unit 200, outputs a traveling signal to the second and third driving units 171, 172, and determines whether an on-signal is inputted from the sensor unit 192.

If the card 300 at an arbitrary position is magnetized by the magnet of the sensor unit 192 and attached to the sensor unit 192, the sensor unit 192 outputs an on-signal. If the control unit 193 of the car 100 detects the on-signal of the sensor unit 192, the control unit 193 outputs a deformation control signal to the first driving unit 170 so as to rotate the bonnet support 120 such that the bonnet support 120 stands in the vertical direction.

At this time, the roof support 130, which is connected to the bonnet support 120 through the link part 140, stands in the vertical direction together with the bonnet support 120, and the bonnet frame 104 and the roof frame 105, which are coupled to the bonnet support 120 and the roof support 130, also stand in the vertical direction together.

In addition, an interval between the roof support 130 and the link part 140 is changed such that the door link parts 160 spread out so as to be arranged in the outward directions.

Further, the fender support 150 connected to the link part 140 moves in the upward direction in response to the vertical standing of the bonnet support 120 and accordingly the fender frames 103 coupled to the fender support 150 are changed in position.

In addition, as the bonnet support 120 stands, the face part 124 disposed on the bottom surface of the bonnet support 120 is exposed and thus the car 100 is deformed into the second shape.

Further, as the bonnet support 120 stands, the sensor unit 192 mounted on the bottom surface of the bonnet support 120 also stands such that the bottom surface of the card 300, which is attached to the magnet 192' of the sensor unit 192, is exposed.

Meanwhile, the first driving unit 170 rotates until the second switch 192*b*, which is mounted on the deformation support 110, outputs an on-signal such that the roof support 130 is fixed at an optimum position, thereby carrying out the accurate deformation into the second shape.

After that, if the card 300 is removed from the sensor unit 192, the sensor unit 192 outputs an off-signal. If the control unit 193 detects the off-signal from the sensor unit 192, the control unit 193 outputs a deformation control signal to the first driving unit 170 such that the bonnet support 120 is restored to the original position thereof.

At this time, the first driving unit 170 rotates until the first switch 192*a*, which is mounted on the deformation support 110, outputs an on-signal such that the bonnet support 120 is fixed at an optimum position, thereby carrying out the accurate deformation to the first shape.

As the bonnet support 120 is restored to the original position, the roof support 130 interlocked with the link part 140 is restored to the original position thereof, and the fender support 150 and the door link part 160 are also restored to the original positions thereof, such that the car 100 is restored to the car shape as the first shape.

(Embodiment 2)

Figure 6:
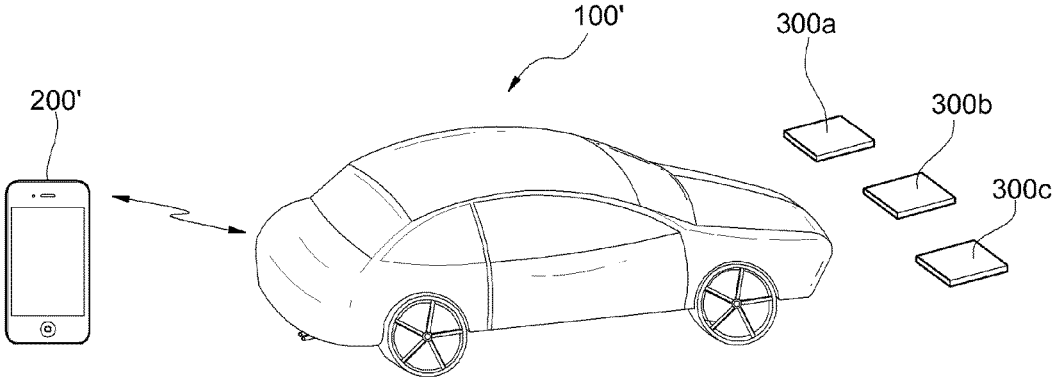
FIG. 6 is a perspective view showing a transformable toy car according to a second embodiment of the present invention.
Figure 7:
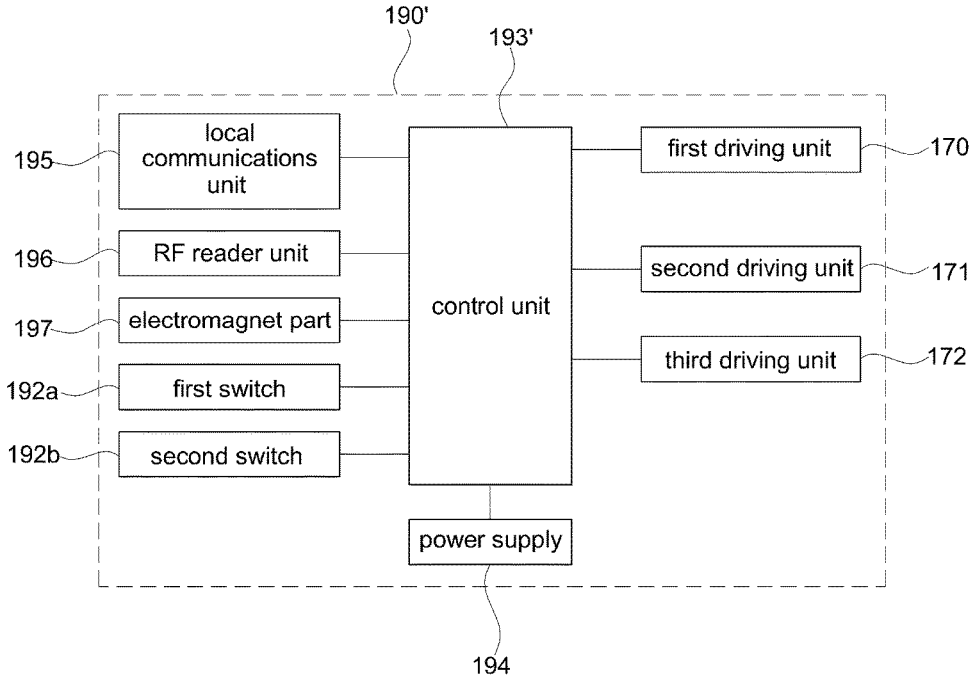
FIG. 7 is a block diagram for showing the electric configuration of the transformable toy car according to the second embodiment of the present invention.

FIG. 6 is a perspective view showing a transformable toy car according to a second embodiment of the present invention, and FIG. 7 is a block diagram for showing the electric configuration of the transformable toy car according to the second embodiment of the present invention.

As shown in FIG. 6 and FIG. 7, a deformable toy car according to a second embodiment of the present invention includes a car 100', a remote control unit 200' and cards 300*a*, 300*b*, 300*c* differently from that of the first embodiment so as to control the driving of a toy car at a remote place, scan an arbitrary card in the process of traveling of the car, and transform the toy car from a car shape into an arbitrary second shape so as to expose the bottom surface of a predetermined card when the predetermined card is selectively attached to the card.

If a control circuit part 190' receives an operation control signal and attachment target card information, which are transmitted from the remote control unit 200', the car 100' carries out traveling operation in an arbitrary direction. If an arbitrary card 300*a*, 300*b*, 300*c* is scanned, the control circuit part 190' compares the scanned card information with the attachment target card information. As a result of the comparison, if the scanned card is an attachment target card, the scanned card is attached to the car 100', and parts of the car body 100', which are rotationally coupled, are deformed from a first shape into a second shape so as to expose the bottom surface of the attachment target card 300*a*, 300*b*, 300*c*. If the attached card 300*a*, 300*b*, 300*c* is removed from the transformed second shape, the deformed parts are restored to the original positions in the first shape.

The control circuit part 190' includes a first switch 192*a*, a second switch 192*b*, a control unit 193', a local communications unit 195, an RF reader unit 196 and an electromagnet part 197.

The first switch 192*a* is a limit switch provided at one side of the deformation support in the horizontal direction, and outputs an on-signal to the control unit 193' so as to finish the operation of the first driving unit 170, when the bonnet support comes to a horizontal state so as to maintain the first shape. That is, the first switch 192*a* outputs an on-signal if the car comes to the first shape.

The second switch 192*b* is a limit switch provided at the other side of the deformation support in the vertical direction, and outputs an on-signal to the control unit 193' so as to finish the operation of the first driving unit 170, when the roof support stands in the vertical direction for the deformation into the second shape. That is, the second switch 192*b* outputs an on-signal if the car comes to the second shape.

If the control unit 193' receives an operation control signal and attachment target card information from the remote control unit 200', the control unit 193' outputs a traveling control signal to the second and third driving units 171, 172 such that the car 100' travels in an arbitrary direction. The control unit 193' compares the information on the card 300*a*, 300*b*, 300*c*, which is scanned by the RF reader unit 196, with the received attachment target card information. As a result of the comparison, the control unit 193' outputs an on-signal to the electromagnet part 197 if the scanned card information conforms to the attachment target card information, while outputs an off-signal to the electromagnet part 197 if the scanned card information does not conform to the attachment target card information. Further, the control unit 193 outputs a deformation control signal so as to rotate the first driving unit 170 forwards or backwards so as to control the deformation of the car 100' from the first shape into the second shape and vice versa.

Further, if the electromagnet part 197 outputs an on-signal and thus the control unit 193' outputs an operation control signal to the first driving unit 170 so as to carry out the deformation from the first shape into the second shape, the control unit 193' outputs the operation control signal until the first switch 192*a* outputs an off-signal and the second switch 192*b* outputs an on-signal, thereby carrying out the accurate deformation from the first shape into the second shape.

In addition, if the electromagnet part 197 outputs an off-signal and thus the control unit 193' outputs an operation control signal to the first driving unit 170 so as to carry out the deformation from the second shape to the first shape, the control unit 193' outputs the operation control signal until the second switch 192*b* outputs an off-signal and the first switch 192*a* outputs an on-signal, thereby carrying out the accurate deformation from the second shape to the first shape.

The local communications unit 195 is a constituent element for transmitting and receiving data signals between the control unit 193' and the remote control unit 200', and uses at least one of RF communications, bluetooth communications, Zigbee communications or infrared-ray communications, preferably the bluetooth communications.

The RF reader unit 196 is a constituent element provided at the lower portion of the bonnet frame of the car 100' and scanning information on an arbitrary card 300*a*, 300*b*, 300*c*, which is placed on the floor, so as to provide the scanned information to the control unit 193', wherein the RF reader unit 196 outputs a predetermined electromagnetic wave signal of predetermined output power to the card 300*a*, 300*b*, 300*c*.

That is, the RF reader unit 196 detects information which is stored in advance from an RF tag provided to the card 300*a*, 300*b*, 300*c*, (for example, information on the capability of an arbitrary character in a predetermined game, and the like).

The electromagnet part 197 selectively generates magnetic force according to the on/off-control signal, which is outputted from the control unit 193', and outputs an on/off-signal according to whether the card 300*a*, 300*b*, 300*c* is attached or not.

That is, if the magnetic substance included in the card 300*a*, 300*b*, 300*c* is magnetized by the magnetic force of the electromagnet part 197 and thus the card 300*a*, 300*b*, 300*c* is attached to the electromagnet part 197, the position of the electromagnet part 197 is changed, outputting an on-signal. If the attached card 300*a*, 300*b*, 300*c* is removed from the electromagnet part 197, the electromagnet part 197 is restored to the original position thereof by the elastic force of the spring (not shown) and outputs an off-signal.

The remote control unit 200' is a control means for outputting a direction control signal such that the car 100' travels in an arbitrary direction, and receiving the attachment target card information input so as to transmit the same to the car 100'. The remote control unit 200' includes any one of a mobile terminal and a tablet PC, which has a local communications means such as bluetooth and the like, preferably a mobile terminal such as a smart phone and the like.

Further, the remote control unit 200' is installed with an executable program for controlling the car 100', the executable program executes a button screen for back-and-forth and right-and-left direction control inputs and an input button screen for inputting attachment target card (300*a*, 300*b*, 300*c*) information, wherein the inputted information is transmitted to the car 100' by using the local communications.

The card 300*a*, 300*b*, 300*c* is a rectangular member and has at least one of letters, numbers, figures, pictures, characters and photographs, printed on the outside, and a magnetic substance and an RF tag, installed therein, wherein the RF tag is activated by the electromagnetic waves outputted from the RF reader unit 196 of the car 100'. As the card 300*a*, 300*b*, 300*c* is activated the RF tag transmits the information stored in advance to the RF reader unit 196.

Next, the operations of the transformable toy car according to the second embodiment will be described in more detail.

First, a bluetooth communications channel is set using pairing between the car 100' and the remote control unit 200', and a user inputs card information for attaching a predetermined card among a first card to a third card 300*a*, 300*b*, 300*c* to the remote control unit 200'.

The remote control unit 200' transmits and stores the inputted attachment target card information to the control unit 193' of the car 100'. Then, the control unit 193' outputs a control signal to the second driving unit 171 and the third driving unit 172 such that the car 100' in the first shape can travel in order to attach an attachment target card to the car 100', according to the operation control signal sent through the remote control unit 200' by the user. In addition, the control unit 193' supplies power of a power supply 194 to the RF reader unit 196 so as to detect the information on the attachment target card, and the RF reader unit 196 scans the first card 300*a*, the second card 300*b* and the third card 300*c* according to an arbitrary sequence controlled by the user. The RF reader unit 196 transmits the card information detected by the scanning to the control unit 193'. Therefore, the control unit 193' compares the transmitted information on the first to third cards 300*a*, 300*b*, 300*c* with the stored attachment target card information.

If the attachment target card information is detected as a result of the comparison, the control unit 193' supplies power to the electromagnet part 197 such that the electromagnet part 197 generates the magnetic force and the attachment target card is attached to the electromagnet part 197.

At this time, if the card is attached to the electromagnet part 197 and thus an on-signal is outputted, the control unit 193' outputs a deformation control signal to the first driving unit 170 so as to deform the toy car from the car shape, that is, the first shape, into the second shape, that is, the robot shape until the second switch 192*b* outputs an on-signal, thereby carrying out the transformation of the car from the car shape, that is, the first shape to the robot shape, that is, second shape.

Further, if the card is removed from the electromagnet part 197 and thus an off-signal is outputted, the control unit 193' outputs a deformation control signal to the first driving unit 170 so as to deform the car from the second shape, that is, the robot shape, to the car shape, that is, the first shape until the first switch 192*a* outputs an on-signal, thereby carrying out the deformation of the toy car from the robot shape, that is, the second shape, to the car shape, that is, the second shape.

Hereinabove, even though the transformable toy car, according to the present invention, is described with reference to the attached drawings, it would be apparent to a person skilled in the art that the invention can be implemented through various modification and changes applied without departing from the technical idea and scope of the present invention as set forth in the accompanying claims.

In addition, the thickness of lines, the size of constituent elements and the like illustrated in the drawings in the process of explaining of the embodiments of the present invention may be illustrated exaggeratedly for the sake of clarity and convenience of explanation. Further, the terminologies used in the above are defined in consideration of the functions in the present invention and might be changed according to the intentions of users and operators or practice. Therefore, the definition of the terminologies should be determined on the basis of the overall contents of the present specification.

The invention claimed is:

1. A transformable toy car, comprising:

a remote control unit configured to transmit an operation control signal; and a car configured to receive the operation control signal to travel in a direction according to the operation control signal, undergo a first transformation from a first shape to a second shape in response to attachment of an arbitrary card to the car, and undergo a second transformation from the second shape to the first shape in response to removal of the attached arbitrary card from the car, wherein the first transformation exposes a bottom surface of the attached arbitrary card, and wherein the car comprises a deformation support fixed on a lower frame, a bonnet support rotationally coupled to one side of the deformation support such that a bonnet frame is deformed between the first shape and the second shape, a roof support rotationally coupled to another side of the deformation support such that a roof frame is deformed between the first shape and the second shape, a link part to connect the bonnet support and the roof support such that the roof support operates together with the bonnet support when the bonnet support rotates, a fender support, of which one side is connected to the link part and another side is connected to fender frames such that the fender frames are deformed between the first shape and the second shape, a first driving unit disposed with the deformation support such that the bonnet support rotates forwards or backwards in a predetermined direction so as to supply driving force, a second driving unit disposed with the lower frame and configured to rotate forwards or backwards so as to supply driving force such that the car travels in a predetermined direction, a third driving unit disposed with the lower frame and configured to rotate forwards or backwards so as to supply driving force such that the car travels in a predetermined direction, auxiliary wheels provided at a lower portion of the lower frame, and a control circuit part configured to output a traveling control signal to the second and third driving units for traveling in an arbitrary direction in response to the operation control signal being received from the remote control unit, and output a deformation control signal according to a determination of whether the arbitrary card is attached such that the first driving unit rotates forwards or backwards based on the determination.

2. A transformable toy car, comprising:

a remote control unit configured to transmit an operation control signal and target card information; and a car configured to receive the operation control signal and the target card information, travel in a direction according to the operation control signal, scan an arbitrary card so as to compare information of the arbitrary card with the target card information, undergo a first transformation from a first shape to a second shape in response to attachment of the arbitrary card to the car and matching of the information, and undergo a second transformation from the second shape to the first shape in response to removal of the arbitrary card from the car, wherein the car comprises a deformation support fixed on a lower frame, a bonnet support rotationally coupled to one side of the deformation support such that a bonnet frame is deformed between the first shape and the second shape, a roof support rotationally coupled to another side of the deformation support such that a roof frame is deformed between the first shape and the second shape, a link part to connect the bonnet support and the roof support such that the roof support operates together with the bonnet support when the bonnet support rotates, a fender support, of which one side is connected to the link part and another side is connected to fender frames such that the fender frames are deformed between the first shape and the second shape, a first driving unit disposed with the deformation support such that the bonnet support rotates forwards or backwards in a predetermined direction so as to supply driving force, a second driving unit disposed with the lower frame and configured to rotate forwards or backwards so as to supply driving force such that the car travels in a predetermined direction, a third driving unit disposed with the lower frame and configured to rotate forwards or backwards so as to supply driving force such that the car travels in a predetermined direction, auxiliary wheels provided at a lower portion of the lower frame, and a control circuit part configured to output a traveling control signal to the second and third driving units for traveling in an arbitrary direction in response to the operation control signal being received from the remote control unit, and output a deformation control signal according to a determination of whether the arbitrary card is attached such that the first driving unit rotates forwards or backwards based on the determination.

3. The transformable toy car according to claim 1, wherein the car further comprises door link parts, and each of the door link parts includes a door coupling hole coupled to a door frame such that the door frame is deformed from the first shape into the second shape, and a link guide coupling part and a roof support coupling hole respectively provided at one side and another side of the door link part with respect to the door coupling hole, the link guide coupling part being rotationally coupled to the link part, and the roof support coupling hole being coupled to the roof support.

4. The transformable toy car according to claim 3, wherein the control circuit part includes:

a RF transceiver configured to transmit and receive data signals with respect to the remote control unit;

a sensor unit for outputting an on/off-signal according to whether a card is attached to a magnet;

a first switch provided to the deformation support so as to output an on/off-signal according to the position of the bonnet support;

a second switch provided to the deformation support so as to output an on/off-signal according to the position of the roof support; and a control unit configured to output the traveling control signal to the second and third driving units so as to carry out travel based on receipt of the operation control signal by the RF transceiver, and the deformation control signal according to the on/off-signal outputted from the sensor unit such that the first driving unit rotates forwards or backwards, and to output the deformation control signal to the first driving unit until any one of the first or second switch outputs an on-signal.

5. The transformable toy car according to claim 2, wherein the car further comprises door link parts, and each of the door link parts includes a door coupling hole coupled to a door frame such that the door frame is deformed from the first shape into the second shape, and a link guide coupling part and a roof support coupling hole respectively provided at one side and another side of the door link part with respect to the door coupling hole, the link guide coupling part being rotationally coupled to the link part, and the roof support coupling hole being coupled to the roof support.

6. The transformable toy car according to claim 5, wherein the control circuit part comprises:

a first switch disposed with the deformation support and outputting an on/off-signal according to the position of the bonnet support;

a second switch disposed with the deformation support and outputting an on/off-signal according to the position of the roof support;

a control unit configured to output the traveling control signal to the second and third driving units so as to carry out travel based on receipt of the operation control signal and the target card information from the remote control unit, compare information on the arbitrary card scanned by an RF reader unit with the received target card information, output an on/off-control signal for an electromagnet part and the deformation control signal for rotating the first driving unit forwards or backwards according to the comparison result, and output the deformation control signal to the first driving unit until any one of the first or second switch outputs an on-signal; and a local communications unit configured to transmit or receive data signals between the control unit and the remote control unit, the RF reader unit configured to scan information on the arbitrary card so as to transmit the scanned information to the control unit, and the electromagnet part configured to generate magnetic force according to the on/off-control signal of the control unit and output the on/off-signal according to the determination whether the target card is attached.

7. The transformable toy car according to claim 2, wherein the remote control unit is any one of a mobile terminal and a tablet PC.

8. The transformable toy car according to claim 1, wherein the communications between the car and the remote control unit are carried out using at least one of RF communications, Zigbee communications or infrared-ray communications.

9. The transformable toy car according to claim 1, wherein the card includes at least one of a magnetic substance or unique ID information.

* * * * *